US006776291B1

(12) United States Patent
Tirado et al.

(10) Patent No.: US 6,776,291 B1
(45) Date of Patent: Aug. 17, 2004

(54) ARTICLE AND APPARATUS FOR PARTICULATE SIZE SEPARATION

(75) Inventors: Juan A. Morales Tirado, Rochester, NY (US); Samir Kumar, Penfield, NY (US); Judith M. Vandewinckel, Livonia, NY (US); Fumii Higuchi, Mississauga (CA)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/670,884

(22) Filed: Sep. 27, 2000

(51) Int. Cl.[7] ..... B07B 4/06; B07B 7/083

(52) U.S. Cl. ..... 209/154; 209/139.1; 209/714

(58) Field of Search ..... 209/714, 713, 209/143, 142, 139.2, 138, 139.1, 154

(56) References Cited

U.S. PATENT DOCUMENTS

| | | | | | |
|---|---|---|---|---|---|
| D30,955 | S | * | 6/1899 | Chapman et al. | D3/282 |
| D32,793 | S | * | 6/1900 | Fauber | 411/427 |
| 1,499,724 | A | * | 7/1924 | Fraser | 209/137 |
| 1,698,361 | A | * | 1/1929 | Dreisbach | 209/714 |
| 2,195,618 | A | * | 4/1940 | Crites | 209/139.1 |
| 2,275,595 | A | * | 3/1942 | Schwartz | 241/58 |
| 2,294,921 | A | * | 9/1942 | Lykken | 209/714 |
| 2,362,142 | A | * | 11/1944 | Lykken et al. | 209/714 |
| 2,367,906 | A | * | 1/1945 | Wall et al. | 209/714 |
| 2,561,388 | A | * | 7/1951 | Lykken et al. | 209/714 |
| 2,728,456 | A | * | 12/1955 | Lykken et al. | 209/714 |
| 2,754,967 | A | * | 7/1956 | Lykken | 209/714 |
| 3,879,980 | A | * | 4/1975 | King, Jr. | 29/523 |
| 4,626,343 | A | * | 12/1986 | Folsberg | 209/138 |
| 4,703,636 | A | * | 11/1987 | Minami | 70/165 |
| 4,786,406 | A | * | 11/1988 | Nied et al. | 209/139.1 |
| 4,841,518 | A | * | 6/1989 | Nozu et al. | 360/99.12 |
| 5,123,711 | A | * | 6/1992 | Woelfel et al. | 29/894.32 |
| 5,190,227 | A | | 3/1993 | Pallmann | 241/79.1 |
| 5,244,481 | A | | 9/1993 | Nied | 55/406 |
| 5,366,095 | A | | 11/1994 | Martin | 209/139.2 |
| 5,377,843 | A | | 1/1995 | Schumacher | 209/139.2 |
| 5,522,706 | A | * | 6/1996 | Mannava et al. | 416/215 |
| 5,633,856 | A | * | 5/1997 | Mukawa | 360/99.12 |
| 5,774,445 | A | * | 6/1998 | Sawi et al. | 369/270 |
| 5,899,396 | A | | 5/1999 | Nied | 241/79.1 |
| 5,927,510 | A | * | 7/1999 | Leute et al. | 209/139.2 |
| 6,109,448 | A | * | 8/2000 | Konetzka et al. | 209/135 |
| 6,260,708 | B1 | * | 7/2001 | Adam et al. | 209/139.2 |
| 6,269,955 | B1 | * | 8/2001 | Morimoto et al. | 209/723 |
| 6,595,368 | B2 | * | 7/2003 | Roberts et al. | 209/139.1 |
| 6,619,484 | B1 | * | 9/2003 | Glad | 209/23 |
| 2002/0070148 | A1 | * | 6/2002 | Roberts et al. | 209/139.1 |
| 2004/0035765 | A1 | * | 2/2004 | Nied | 209/713 |

FOREIGN PATENT DOCUMENTS

| | | |
|---|---|---|
| WO | WO 97/09130 | 3/1997 |

* cited by examiner

*Primary Examiner*—Donald P. Walsh
*Assistant Examiner*—Daniel K Schlak
(74) *Attorney, Agent, or Firm*—Eugene O. Palazoo, Esq.; Fay, Sharpe, Fagan, Minnich & McKee, LLP

(57) ABSTRACT

An article including: disk or vortex ring with a circular opening in the center of the disk; and a fastener adapted to concentrically attach the disk to the particle outlet opening of a classifier wheel.

22 Claims, 10 Drawing Sheets

ARTICLE AND APPARATUS FOR PARTICULATE SIZE SEPARATION

REFERENCE TO COPENDING AND ISSUED PATENTS

Attention is directed to commonly owned and assigned U.S. Pat. Nos. 5,133,504; 5,562,253; and 5,927,510.

Attention is directed to commonly owned and assigned, copending application USSN 09/615,819 filed Jul. 13, 2000, entitled "PARTICULATE SMOOTHING PROCESS," wherein there is disclosed an apparatus including: a grinder adapted to grind toner particles; a classifier in communication with the grinder adapted to separate sized toner particles from unsized toner particles; a conduit in communication with the classifier which conduit is adapted to convey the sized toner particles away from the grinder; a heater adapted to heat and smooth the surface of the sized toner particles received from the conduit; and a particle separator adapted separate the resulting mixture of smooth surface toner particles and debris particles received from the heater.

The disclosures of each the above mentioned patents and copending applications are incorporated herein by reference in their entirety.

BACKGROUND OF THE INVENTION

The present invention is generally directed to an apparatus and processes thereof for the preparation of particulate materials with narrow particle size distribution properties. More specifically, the present invention relates to improved classifier chamber geometries, such as a reduced or variable fine particle outlet diameter, and which diameters enable a high level of control over the physics of the separation process in the classifier, such as the particle size and quality of the particle separation, and thereby provides unexpected and superior particle size separation quality in a classifier. Furthermore the present invention provides the componentry and a method for making a convenient retrofit or adaptation of an existing conventional classifier apparatus to provide the advantages of the present invention.

In particle processing arts, for example, for the preparation of fine and uniformly disperse particulate materials, there exists various equipment and mechanical processes for achieving selective separation of particulate powders into eligible and non-eligible particle size fractions or ranges, and are collectively referred to as classifiers and classification equipment and processes.

In the manufacture of particulate powders, such as electrostatographic toner compositions, a classifier apparatus employing a rotating wheel is commonly used to accomplish classification. In general, the rapidly rotating classifier wheel creates a dynamical fluid vortex which provides the necessary forces to achieve separation of particles greater than a certain size from particles less than a certain size.

The extent or sharpness of the separation of particles of different sizes achieved by the classifier is an important measure of the quality of the separation equipment and process, and is generally reflected in the quality of the resultant particles, for example, the physical performance characteristics and properties of the particles. The sharpness of the separation is also a measure of how well the classifier can discriminate among similarly sized particles. Ideally, a classifier will separate a feed particle stream containing a mixture of fine and coarse particles sizes into two distinct streams: a coarse stream and a fines stream with little or no overlap in size distribution.

The degree of sharpness of the separation is measured, for example, using a coarse grade efficiency calculation. The calculation indicates what fraction of particles with a certain size will travel to the coarse stream, and what fraction will travel to the fines stream. A ratio of the size at which 25 percent of the particles travel to the coarse stream ($D_{25}$) and the size at which 75 percent of the particles travel to the coarse stream ($D_{75}$) is used as a nominal measure of sharpness ($D_{25}/D_{75}$). An ideal separation provides a sharpness ($D_{25}/D_{75}$) equal to 1. In currently available commercial classification equipment, a sharpness index exceeding a value of 0.7, for example, from about 0.7 to about 1.0, is considered to be excellent and considered difficult to attain without exceptional effort and operating conditions. Other classification metrics include ($D_{84}/D_{50}$) which is referred to as Upper Geometric Size Distribution (UGSD). This metric is determined from the fines stream of a certain volume median and distribution resulting from the separation and is a good indicator of separation sharpness. In general, the lower the Upper Geometric Size Distribution for a certain volume median size, the higher the sharpness index.

Commercially available classifier wheels generally provide little or no profiling, or only provide a profile which maintains a constant wheel height or constant air flow radial velocity. These conditions typically result in a particle cut point situation which diminishes towards the particle outlet, and is believed to lead to an undesirable buildup of solids concentration in the free vortex region. This buildup of solids concentration in the free vortex region is believed to have a detrimental effect on the sharpness index.

The present invention in embodiments overcomes these and other problems encountered in the prior art.

PRIOR ART

Commonly owned and assigned U.S. Pat. No. 5,927,510, to Leute, et al., issued Jul. 27, 1999, discloses an apparatus for the classification of solid particulates entrained in a fluid, comprising: a housing provided with a feed inlet, a fine fraction outlet, and a coarse fraction outlet; and a classifier wheel having an upper and lower surface, and a plurality of blade vanes connecting the upper surface to the lower surface at the peripheral edges of the upper and lower surfaces, and wherein the wheel has a constant cut point geometry.

U.S. Pat. No. 5,244,481, issued Sep. 14, 1993, to Nied, discloses a vertical air separator with a rotating separator wheel upon which separating air loaded with fine goods flowing from outside towards the inside impinges, from which the separating air axially flows off through an outlet connection pipe in order to be guided to its further use, e.g. in a filter or the like, the separating wheel being provided with a down stream cover plate and a second cover plate being axially distance therefrom, and blades being disposed between the two cover plates at their periphery, and the outlet connection delivery end averted from the separating wheel emptying into an outlet chamber the cross section of which is distinctly larger than the cross section of the said outlet connection pipe so that there occurs an abrupt change of the cross section between the outlet connection pipe and the outlet chamber. A constant radial velocity wheel is described, wherein the airflow velocity is constant regardless of the radial position in the wheel, reference col. 7, lines 21–32.

U.S. Pat. No. 5,377,843, to Schumacher, issued Jan. 3, 1995, discloses a classifying wheel for a centrifugal-wheel air classifier, through which the classifying air flows from outside to the inside against its centrifugal action. The wheel has blades arranged in a ring extending parallel to the axis of rotation of the wheel. The blades are positioned between a circular disc carrying the classifying wheel hub and an annular cover disc. The classifying wheel is entirely made in one piece and of a wear-resistant sintered material. The flow channels of the classifying wheel are formed by the surfaces of the classifying wheel blades extending parallel to each other and in direction of the axis of rotation of the wheel. The cut point of the fine product can be precisely controlled by varying the rotational speed of the turbine. This maintenance free design produces unmatched sharpness in cut size. The lack of internal seals makes oversize "leakage" impossible and allows air flows to be maximized resulting in extremely high product yields.

U.S. Pat. No. 5,366,095, to Martin, issued Nov. 22, 1994, discloses an air classification system comprised of dual cylindrical chambers mechanically separated, to allow a zone of atmospheric air in between. A primary classification chamber is situated vertically below a concentric secondary classification chamber. A rotating parallel blade turbine is situated within the lower primary chamber in order to effect centrifugal particle classification upon a feed material intimately mixed in an air stream. A tubular rotary discharge connected to the turbine which passes through the zone of atmospheric air separating the dual chambers, and extends into the upper secondary chamber which exits to collect and discharge the classified product from the system. A classifier of this design is capable of separating ultra fine particles without stray amounts of oversize with extremely high fine product yields.

The aforementioned references are incorporated in their entirety by reference herein.

In the particle separation and classification processes of the prior art, various significant problems exist, for example, difficulties in predicting or controlling both the particle size and particle size distribution of the particulate products produced. Other disadvantages associated with the prior art methods for separating particulate materials are that they typically provide products with highly variable particle size and or particle size distribution properties. These and other disadvantages are avoided, or minimized with the apparatus and processes of the present invention.

Thus, there remains a need for particle separation apparatus and processes, which provide for the simple and inexpensive preparation, separation, and classification of the particulate material, for example, pigmented resin particles used in dry toner and liquid ink applications. Practitioners in the art have long sought an inexpensive, efficient and environmentally efficacious means for producing narrow particle size distributions using conventional classification and separation equipment, having operator controllable or selectable particle size and particle size distribution properties.

SUMMARY OF THE INVENTION

Embodiments of the present invention, include:

An article comprising:

a disk with a circular opening in the center of the disk; and a fastener adapted to concentrically attach the disk to the particle outlet opening of a classifier wheel;

A modified classifier wheel comprising:

an upper solid surface and a lower surface with a first circular opening therein;

a plurality of blade vanes connecting the upper surface to the lower surface at the peripheral edges of the upper and lower surfaces, and an article as described above which is fixed to the lower surface which forms a second circular opening within the first circular opening and effectively reduces the diameter of the first circular opening;

An apparatus for the classification of solid particulates entrained in a fluid, comprising:

a housing provided with a feed inlet, a fine fraction outlet, and a coarse fraction outlet; and a modified classifier wheel as described above;

A process for separating and classifying particulates including:

providing an apparatus as described above;

rotating the classifier wheel at speed of from about 500 to about 25,000 revolutions per minute, and preferably from about 500 to about 5,000 revolutions per minute; and introducing to the apparatus a solid particle feed comprising a fluid stream containing particulates of from about 0.1 to about 1,000 microns in diameter, wherein the fine particles in the particle feed move toward the center of the wheel and thereafter exit the classifier wheel and housing via the fine fraction outlet opening, and the coarse particles move toward the periphery of the wheel and exit the wheel via the coarse fraction outlet; and A kit for retrofitting an existing classifier wheel to enable embodiments of the present invention wherein the kit comprises:

a disk with a circular opening in the center of the disk; and at least one fastener adapted to attach the disk to the fine particle outlet of an a existing classifier wheel.

These and other embodiments of the present invention are illustrated herein.

DETAILED DESCRIPTION OF THE INVENTION

The particulate classification article, separation apparatus, and processes thereof, of the present invention, including a kit for retrofitting an existing classifier wheel to enable embodiments of the present invention, may be used to process and prepare a variety of particulate materials, including toner particles for used in liquid and dry developer marking applications in a cost efficient manner. An advantage of the present invention is that the apparatus and processes thereof afford a high level of control over the particle size and particle size distribution properties of the resulting separated fine particulate products and provides enhanced efficiency.

Figure 1:
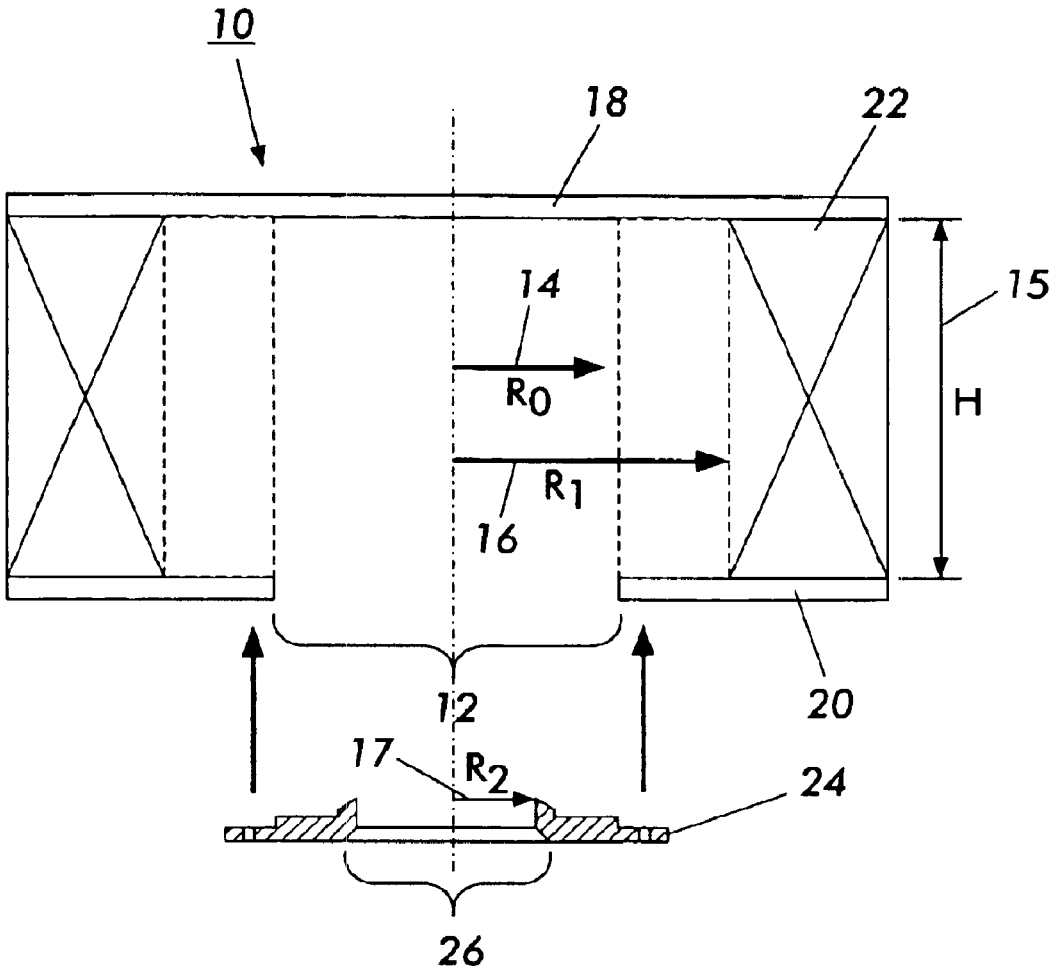
FIG. 1 illustrates a cross sectional profile of a classifier wheel with an exploded view of an exemplary high spin vortex ring insert article of the present invention.

Referring to the Figures, FIG. 1 illustrates a cross sectional profile of a classifier wheel (10) with an exploded view of an exemplary high spin vortex ring insert article (24) of the present invention. The wheel (10) can be a known classifier wheel with conventional components such as a fine particle outlet of diameter (12) and radius (14 or $R_0$), an upper surface (18), a lower surface (20), and a plurality of internal vanes (22) of height (15 or H) which connect and support the upper and lower surfaces and create an internal diameter (16 or $R_1$) and further provide a cavity which facilitates the formation of a vortex flow geometry within the wheel for the separation of fine particulate material. The high spin vortex ring insert article (24) can be affixed to the classifier wheel (10) at the fine particle outlet opening (12) with one or more conventional fasteners, such as a screw or screws, a clamp or clamps, a adhesive or adhesives, a press fitting, and the like fasteners, and combinations thereof. The affixed insert article (24) provides a second or reduced diameter fine particle outlet opening (26) of radius (17 or $R_2$) which permits the enhanced particulate separation characteristics of the present invention.

Figure 2:
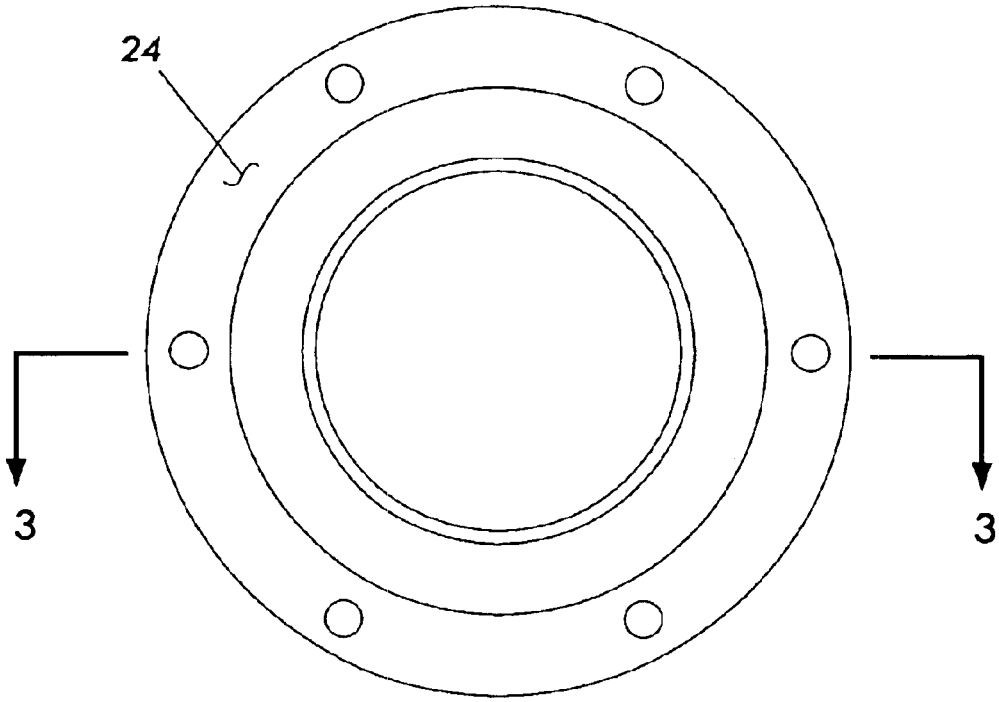
FIG. 2 illustrates bottom view of an exemplary high spin vortex ring insert article of the present invention.

FIG. 2 illustrates a bottom view of a high spin vortex ring insert article (24) of the present invention showing the reduced diameter fine particle outlet or aperture and six exemplary fastener holes.

Figure 3:
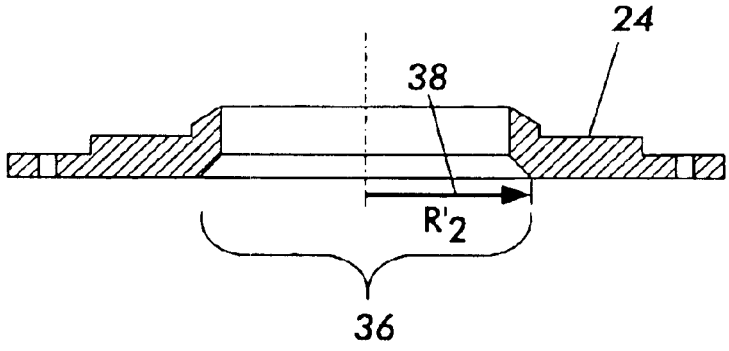
FIG. 3 illustrates a cross sectional profile of an exemplary fixed diameter opening high spin vortex ring insert article of the present invention.

FIG. 3 illustrates a cross-section of an exemplary fixed diameter opening of the high spin vortex ring insert article of FIG. 2. In embodiments the opening or aperture (26) of FIG. 1 can be beveled to provide an intermediate size diameter opening (36) of radius (38 or $R'_2$).

Figure 4:
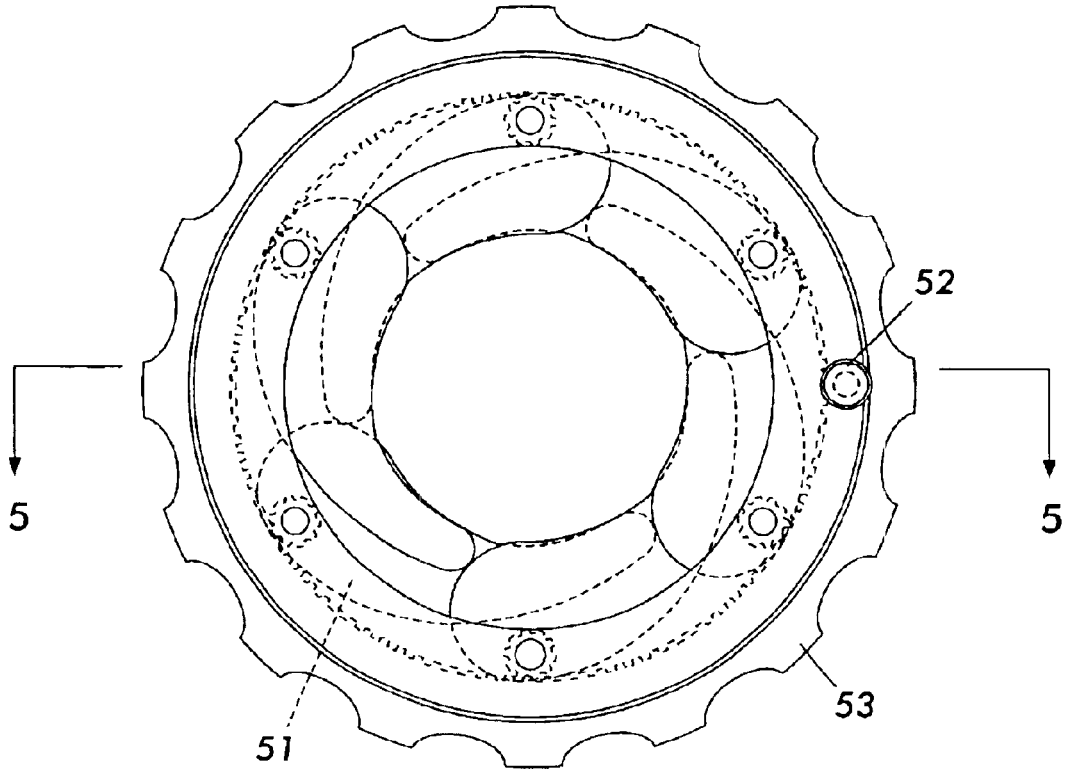
FIG. 4 illustrates a cross sectional profile of an exemplary iris-type variable diameter opening high spin vortex ring insert article of the present invention
Figure 5:
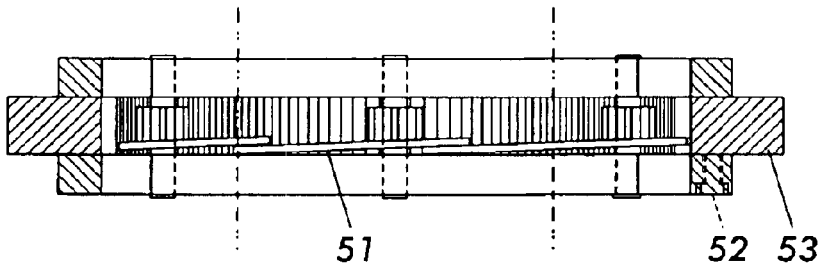
FIG. 5 illustrates a cross sectional profile of an exemplary iris-type variable diameter opening high spin vortex ring insert article of the present invention.

FIG. 4 illustrates a cross-section profile of an exemplary variable or adjustable diameter or iris-type opening high spin vortex ring insert article. The adjustable diameter iris-type opening article can further include a raised lip or chamfer (not shown) similar to that shown in FIG. 3. The iris-type opening is analogous to those found in, for example, light lens cameras and can be constructed by, for example, adapting any known and commercially available iris valve to the ring insert article of the present invention, including, for example, overlapping adjustable panels or petals (51), and a recessed adjustment set screw (52) which engages a main diameter planetary adjust gear (53). FIG. 5 illustrates a cross-section view of the variable or adjustable diameter or iris-type opening high spin vortex ring insert article of FIG. 4 including the overlapping adjustable panels (51), and a recessed adjustment set screw (52) which engages a diameter planetary adjust gear (53).

Figure 6:
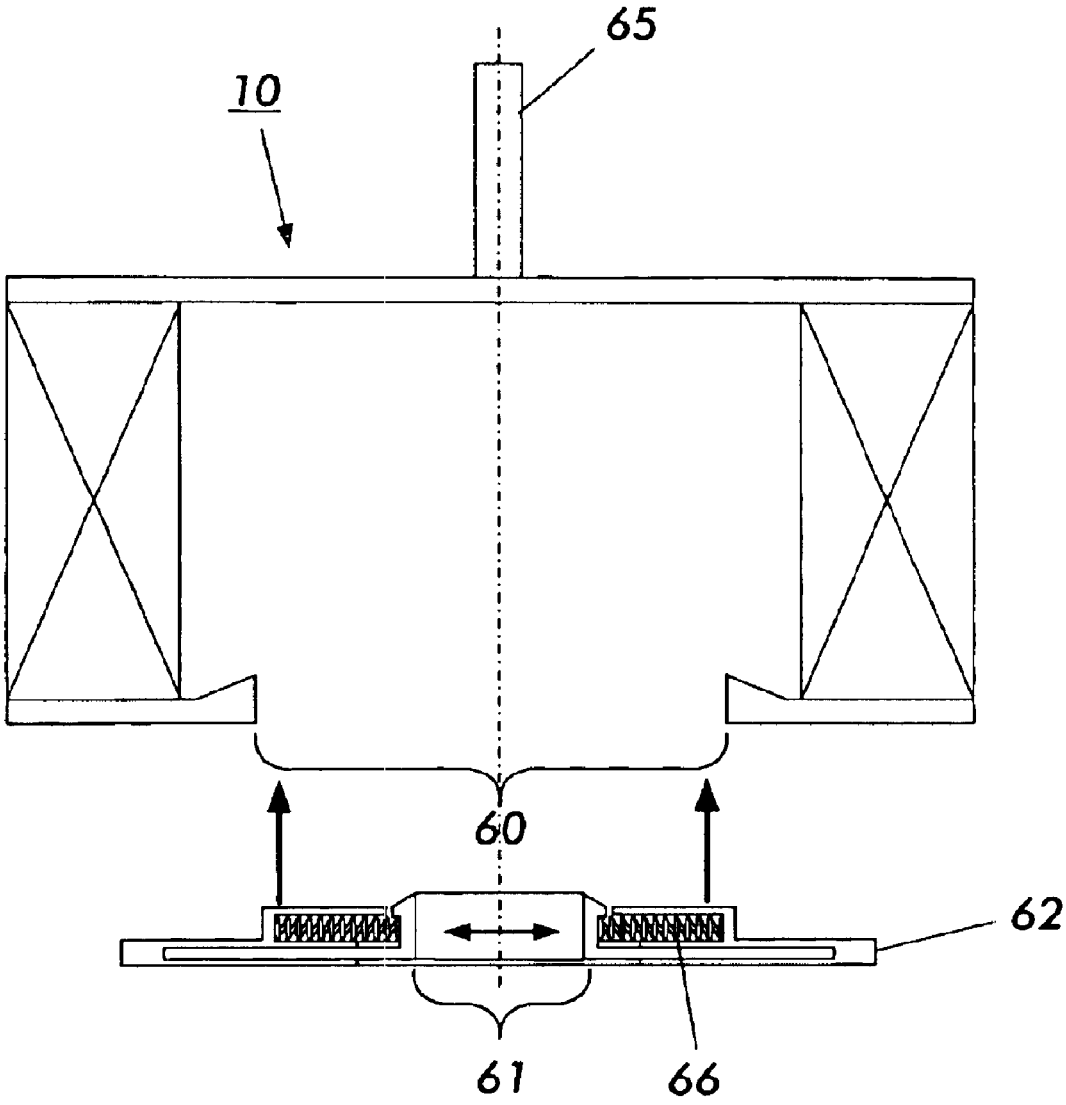
FIG. 6 illustrates a cross sectional profile of an exemplary centrifugal-type variable diameter opening high spin vortex ring insert article of the present invention
Figure 7:
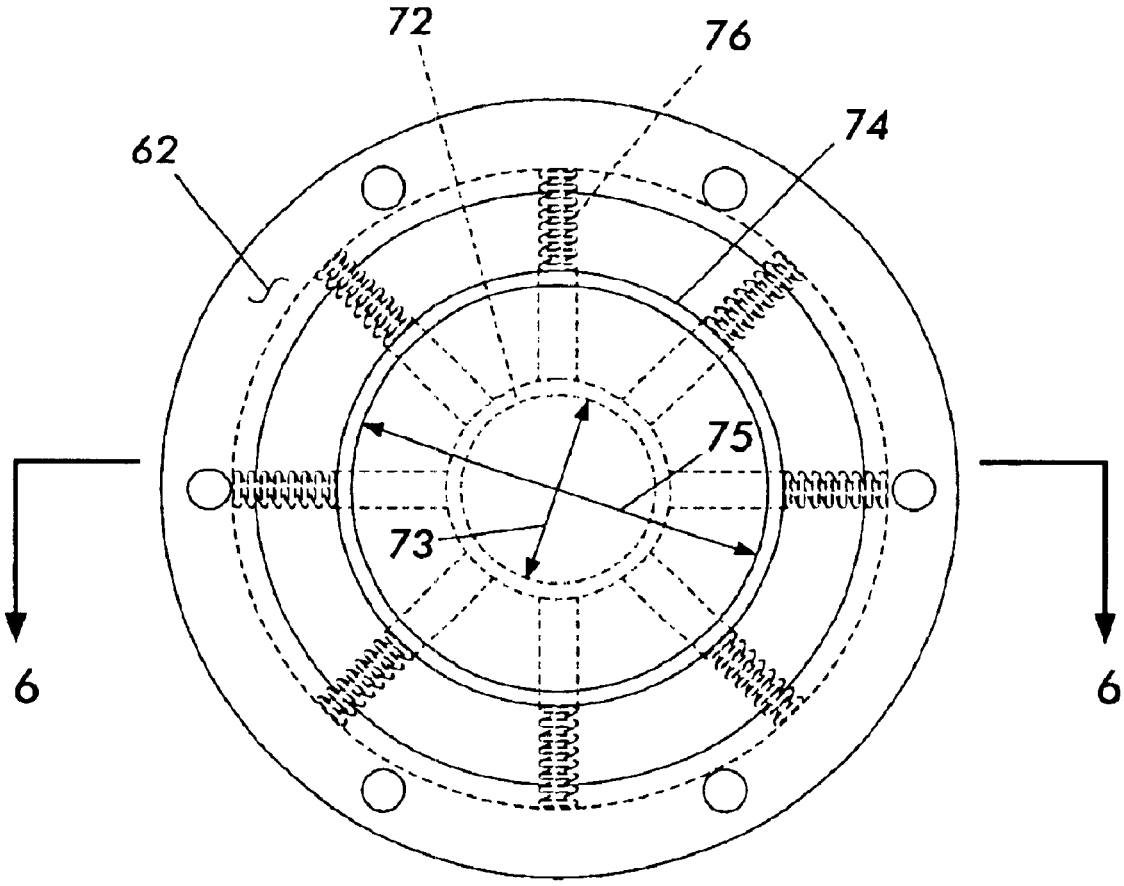
FIG. 7 illustrates a bottom view of the centrifugal-type variable diameter opening high spin vortex ring insert article of FIG. 6 of the present invention

FIG. 6 illustrates a view of an exemplary centrifugal variable diameter opening high spin vortex ring insert article (62) of the present invention. The article (62) is affixed to the opening (60) of the wheel (10) and which opening (61) increases its diameter, for example, proportionately as the classifier wheel speed increases. Thus, for example, when the rotational speed of the drive shaft (65) or comparable drive means and consequently the classifier wheel (10) is low, the diameter of the fine particle outlet or fines opening (61) is relatively small, or alternatively, the smallest. When the rotational speed of the wheel (10) is high the diameter of the opening is comparatively relatively large (64) or increases to an equilibrium diameter. In embodiments, for example, the variable opening can be bounded by one or more spring members (66) which are centrifugally sensitive to the rotational velocity of the classifier wheel and the affixed vortex ring (62). The springs compress in accordance and in proportion to the resultant centrifugal force exerted thereon and thereby permits a larger effective opening diameter. Turning to FIG. 7 there is illustrated a bottom view of the centrifugally variable diameter opening high spin vortex ring insert article (62) of companion FIG. 6. The aforementioned equilibrium opening diameter is illustrated as the balance point between the centrifugal forces acting on the small (72 phantom lines) vortex ring opening and large (74) vortex ring opening and the opposing forces from springs (76) which result, respectively, in slow or small diameter opening (73 phantom lines) and fast or large diameter opening (75).

Figure 8:
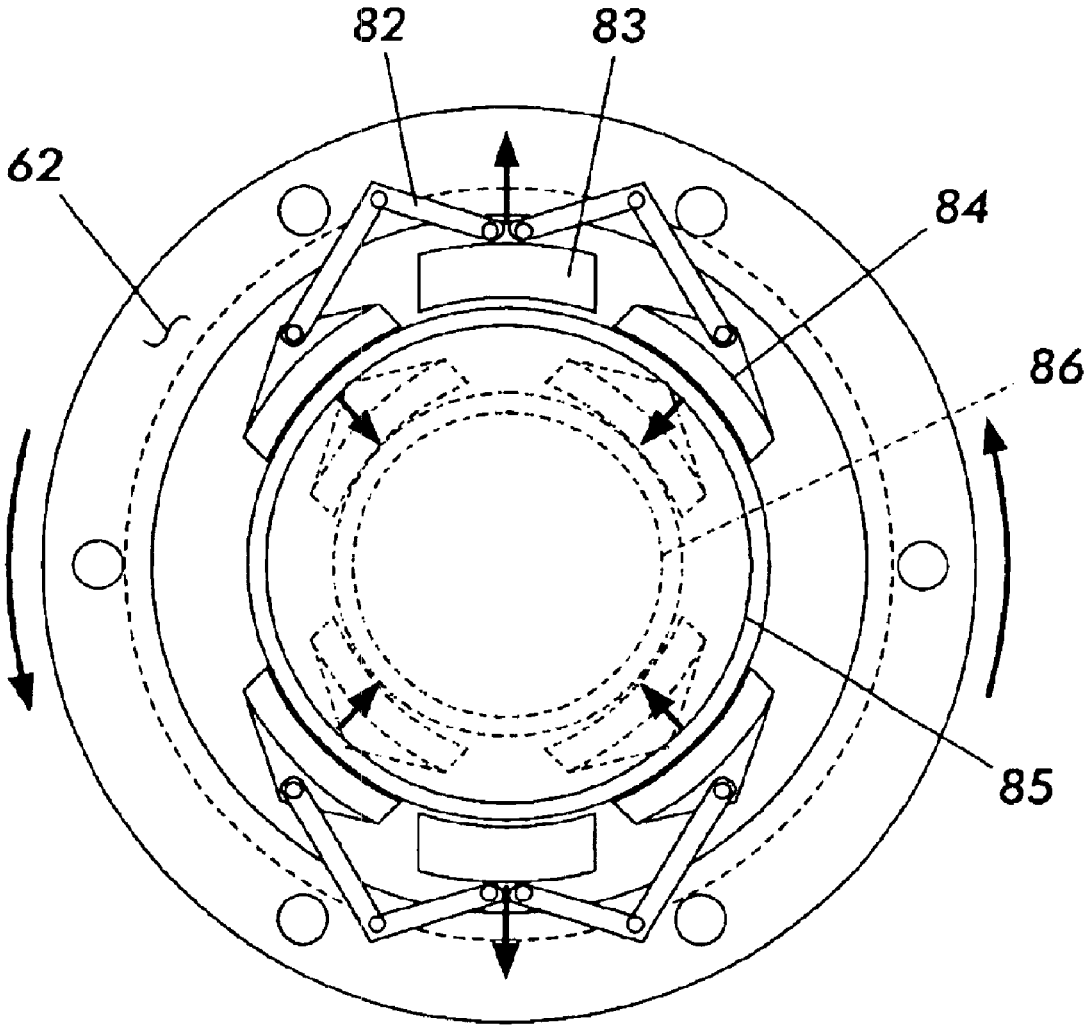
FIG. 8 illustrates a bottom view of an exemplary inverse centrifugal-type variable diameter opening high spin vortex ring insert article of the present invention.

FIG. 8, conversely, illustrates a view of an "inverse" centrifugally variable diameter opening high spin vortex ring insert article where, for example, when the rotational speed of the wheel drive shaft(not shown) or comparable drive means, and consequently the classifier wheel(not shown) is low, the diameter of the fine particle outlet or fines opening is relatively large, for example (85). When the rotational speed of the wheel is high the diameter of the opening is comparatively relatively small, for example (86). In embodiments, for example, the variable opening can be bounded by one or more reciprocating lever or spring members (82) attached to dense weighted member (83) which is centrifugally sensitive to the rotational velocity of the classifier wheel and can be forced outward or away from the classifier wheel rotational axis in response to an increase in wheel speed and the resultant centrifugal force exerted thereon causing less dense counterweight member(s) (84) to move inward toward the classifier wheel rotational axis and to contact the vortex ring opening thereby causing a contraction of the outlet in vortex ring and a smaller effective opening or diameter with an increase in the rotational velocity of the classifier wheel. Conversely, as the classifier wheel turns more slowly the contracted vortex ring (86) expands to expanded vortex ring (85) to enlarge its effective diameter in proportion to the wheel speed. In the foregoing variable diameter embodiments mentioned above it is readily appreciated by one of ordinary skill in the art that the area between the periphery of the insert article and the variable diameter vortex ring can be, for example, any suitable material such as flexible metal, plastic, rubber, and the like sheeting material which can accommodate the change in diameter of the vortex ring article opening. Similarly, when the vortex ring article employs a lip or rim structure or chamfer as depicted in FIG. 3, the lip or rim structure can be constructed of a suitable material to permit the lip or rim structure to expand or contract proportionately to the change in the ring diameter, for example, a slidable hollow ring which permits partial collapse of the ring upon or within itself.

Figure 9:
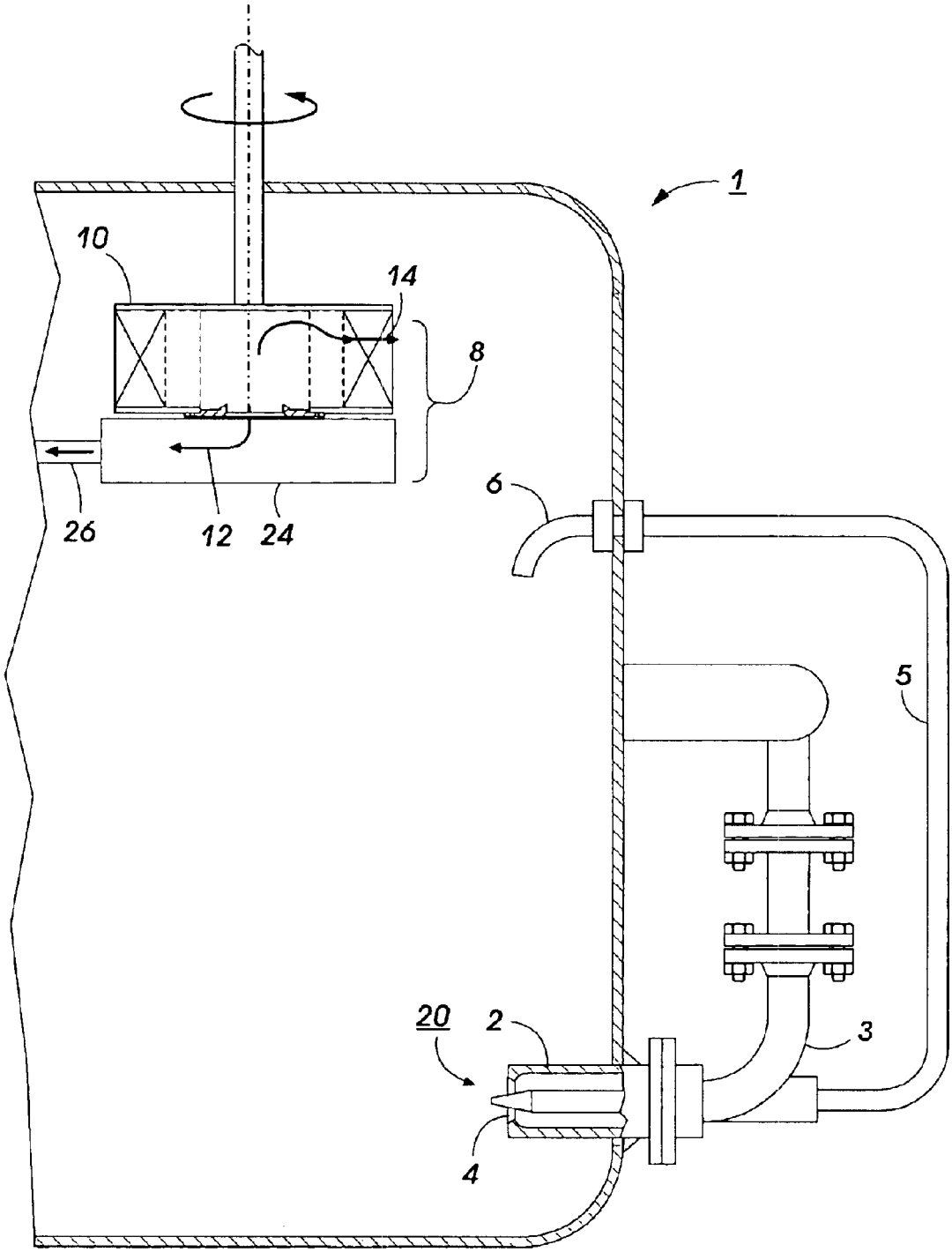
FIG. 9 illustrates a cross sectional profile of a grinder-classify apparatus including a high spin vortex ring insert article of the present invention.

FIG. 9 illustrates a cross-section of a grinder-classify apparatus (1) including a high spin vortex ring modified classifier (10), for example, as shown in FIG. 1, in combination other known grinder-classifier components, such as a classifier wheel and fines collection assembly (8) which includes a fines collection member (24) and fines transport member (26), a jetting nozzle or nozzles (20) and associated plumbing in elements (2, 3, 4, 5, and 6), reference for example, the aforementioned commonly owned U.S. Pat. No. 5,927,510, the disclosure of which is incorporated by reference herein in its entirety, where arrows (12) and (14) show respectively the fine particle cut and coarse particle cut separation streams.

Figure 10:
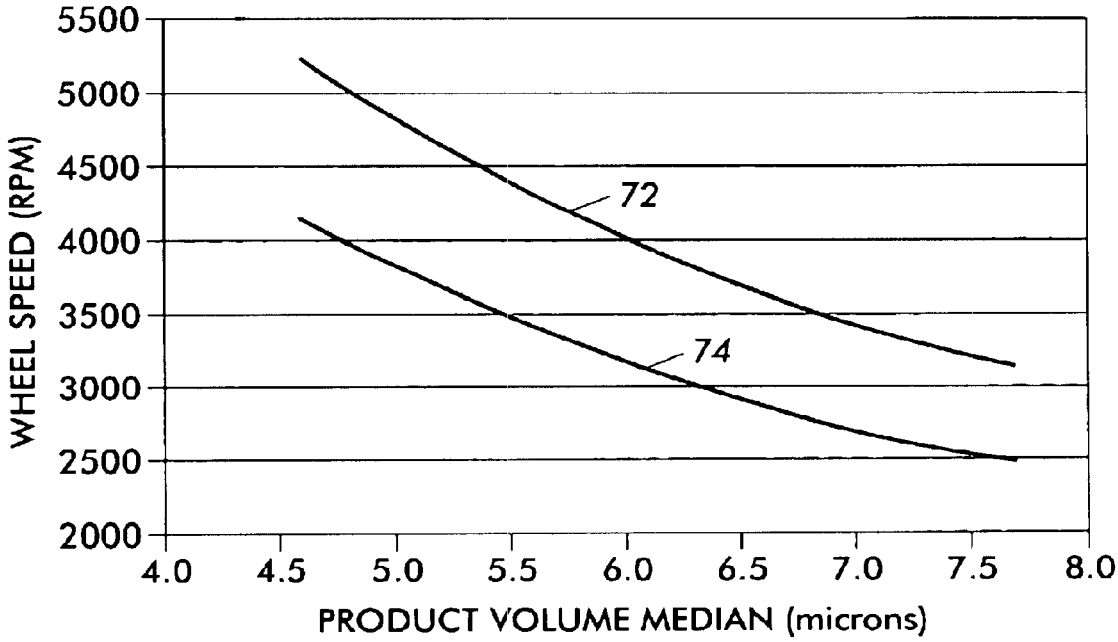
FIG. 10 is a graphical representation of the relationship between the classifier wheel speed and volume median of the separated particles at different outlet diameters at 120 p.s.i.g. grind pressure.

FIG. 10 is a graphical representation of the relationship between the classifier wheel speed with two different fixed diameter apertures and the volume median of the separated fine particles at different outlet diameters and at a constant 120 p.s.i.g. grind pressure. Curve (72) represents a modified vortex outlet with a diameter of about 135 millimeters and curve (74) represents a modified vortex outlet with a diameter of about 106 millimeters. The relationship between wheel speed and particle product volume median diameter appears to be approximately inverse, that is, as the wheel speed increases the fines volume median cut decreases in diameter.

Figure 11:
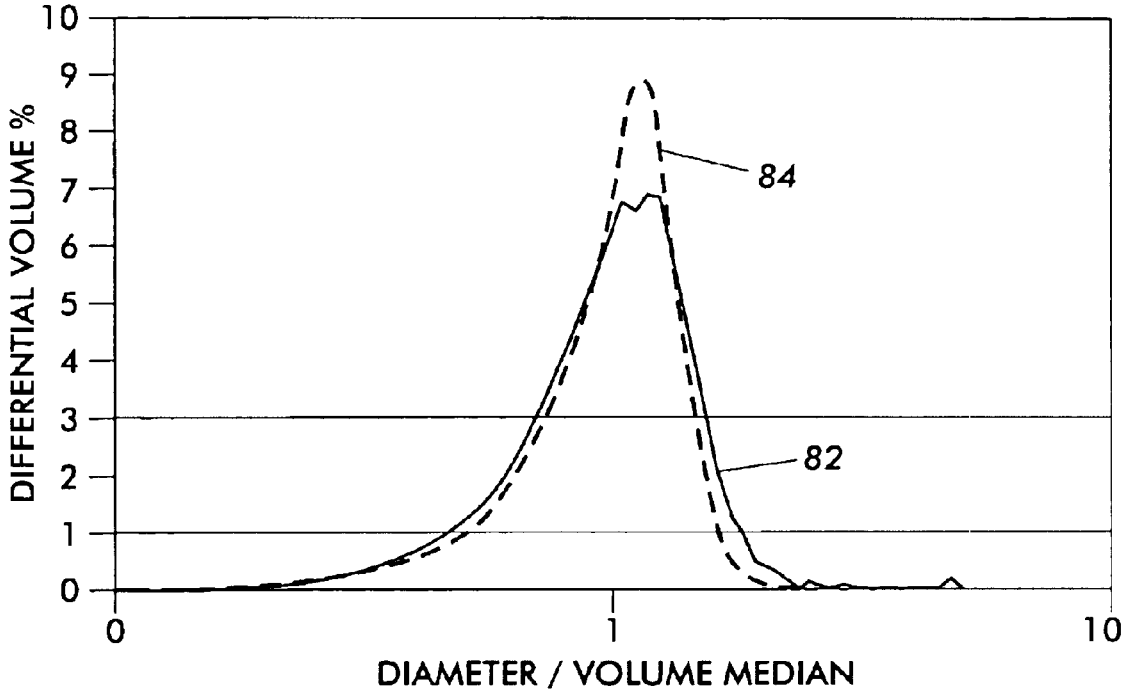
FIG. 11 is a graphical representation of the relationship between the normalized differential volume distribution and the volume median or diameter of separated particles in embodiments of the present invention.

FIG. 11 is a graphical representation of the relationship between the normalized differential volume distribution and the volume median or diameter of the separated particles. Solid line curve (82) represents the fine particle material obtained from a AFG Model Alpine 200 fluidized jet mill. Dashed line curve (84) represents the fine particle material obtained from a AFG Model Alpine 800 fluidized jet mill. The AFG Model Alpine 800 fluidized jet mill has a scale up factor of around 30 with respect to the AFG Model Alpine 200. The scale-up factor is determined from the power delivered by the gas phase exiting the nozzles at the two scales based on thermodynamics of adiabatic expansion of a gas. Other relevant differences between the two jet mills include the number of jet streams and the number of classifier wheels. The AFG Model Alpine 800 fluidized jet mill can have, for example, 4 or 5 jet streams depending on the application, while the AFG Model Alpine 200 has only 3. The AFG Model Alpine 800 fluidized jet mill typically can have three resident classifier wheels. The AFG Model Alpine 200 has only 1 resident classifier wheel. Finally, the height and width of the AFG Model Alpine 800 fluidized jet mill are around three times the height and width of the AFG Model Alpine 200 fluidized jet mill. The results here, when compared to those obtained with an unmodified classifier wheel, indicate that the high spin vortex rings of the present invention permit the obtention of a narrower size particle distribution of small sized or fine toner particles compared to the particle size distributions obtained without the use of the high spin vortex rings.

Figure 12:
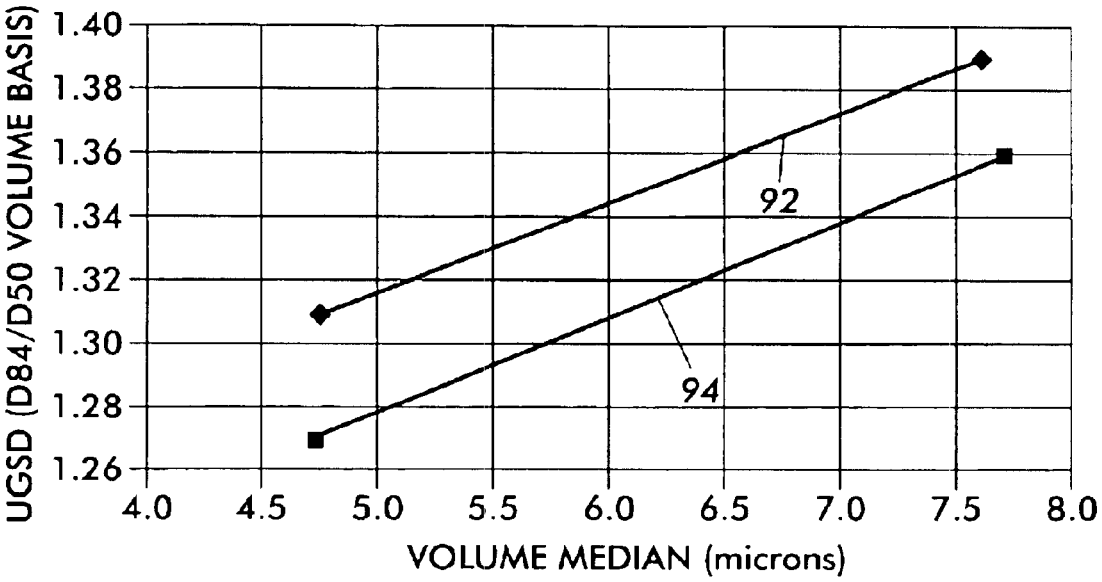
FIG. 12 is a graphical representation of the relationship between the separated particles Upper Geometric Size Distribution and the volume median of the separated at particles obtained for two different high spin vortex ring diameters in embodiments of the present invention.

FIG. 12 is a graphical representation of the relationship between the separated particle size distribution and the volume median of the separated particles obtained for two different high spin vortex ring diameters. Curve (92) represents the relationship of fine particle material obtained with a 127 millimeter diameter modified vortex ring. Curve (94) represents the relationship of fine particle material obtained with a 100 millimeter diameter modified vortex ring.

Thus in embodiments the present invention provides an article comprising:

a disk with a circular opening in the center of the disk; and a fastener or fasteners adapted to attach, for example and preferable symmetrically and concentrically, the disk to the classifier wheel fine particle outlet opening. The thickness of the vortex insert disk can be of the same thickness or greater thickness near the particle outlet and the same thickness or thinner near the periphery of the disk. The vortex insert can in embodiments further comprise a lip or rim structure which is preferably immediately adjacent to the circular opening, and which lip or rim can have a thickness, for example, of from about 1.5 to about 5 times the thickness of the disk. In embodiments of the present invention, the diameter of the circular opening can be fixed and can be changed or adjusted by physical removal or replacement of the vortex ring, for example, by an operator or a robot. In other embodiments, the diameter of the circular opening in the vortex ring or disk can be variable or adjustable. Examples of a manually or remotely adjustable vortex ring structures are, a known iris aperture value adapted accordingly to the needs and requirements of the present invention, such as strength, durability, impact resistance, and the like properties; a centrifugally sensitive or responsive aperture value, that is, as the revolutions-per-minute of the classifier wheel increase the diameter of the aperture increases accordingly, reference FIGS. 6 and 7; an inverse centrifugal aperture valve, that is, as the revolutions per minute of the classifier wheel increase the diameter of the aperture decreases accordingly, reference FIG. 8. In embodiments, the diameter of the circular opening can be, for example, from about 1 centimeter to about 10,000 centimeters including from about 5.0 centimeters to about 13.5 centimeters. The diameter of the vortex ring or disk can be, for example, from about 10 centimeters to about 1.000 centimeters including from about 7 centimeters to about 24.0 centimeters. The fastener or fasteners which fix the vortex ring to an existing classifier wheel can be, for example, one or more bolts or screws, one or more clamps, one or more suitable adhesives, and the like fasteners, and combinations thereof.

In embodiments the present invention provides a classifier wheel comprising:

an upper solid surface and a lower surface with a first circular opening therein;

a plurality of blade vanes connecting the upper surface to the lower surface at the peripheral edges of the upper and lower surfaces, and a vortex ring article with a fixed or variable opening as disclosed above, which article is fixed to the lower surface of the classifier wheel and which forms a second circular opening within the first circular opening and effectively reduces the diameter of the first circular opening.

The classifier wheel can be a conventional or known classifier wheel, reference the aforementioned commonly owned patents, and the wheel can have an internal height (H), for example, of from about 10.0 centimeters to about 20.0 centimeters. The wheel can have a lower surface diameter(D) of from about 20.0 centimeters to about 30.5 centimeters, which includes both the lower surface and the outlet opening. The second circular opening of the vortex ring can have a diameter(d), for example, of from about 5.0 centimeters to about 13.5 centimeter. In embodiments the upper surface and the lower surface can be substantially parallel. In other embodiments the upper surface and the lower surface can be inwardly curvilinear from about the peripheral edges of the wheel to about the center of the wheel.

The present invention, in embodiments provides an apparatus for the classification of solid particulates entrained in a fluid, comprising: a housing with a feed inlet, a fine fraction outlet, and a coarse fraction outlet; and a modified classifier wheel as described above. The fluid can be compressed air or other suitable gases such as inert gases such as nitrogen or argon. The solid particulates can be any friable material with mixed particle sizes. The solid particles are preferably a toner formulation including, for example, a mixture of a pigment and a resin.

In embodiments the present invention provides a process for separating and classifying particulates in the apparatus as described above comprising:

rotating the classifier wheel at speed of from about 500 to about 25,000 revolutions per minute, and preferably from about 500 to about 5,000 revolutions per minute; and introducing to the apparatus a solid particle feed comprising a fluid stream containing particulates of from about 0.1 to about 1,000 microns in diameter, wherein the fine particles in the particle feed move toward the center of the wheel and thereafter exit the classifier wheel and housing via the fine fraction outlet opening, and the coarse particles move toward the periphery of the wheel and exit the wheel via the coarse fraction outlet. The particulates in the fluid stream are preferably continuously classified within the apparatus to permit a separated fine particle fraction with a weight average particle diameter, for example, of from about 0.1 to about 10 micrometers, and preferably of from about 1 to about 5 micrometers, and with a standard deviation of from about 0.1 to about 0.5 micrometers. The separation and classification processes of the present invention can be practiced on small, intermediate, and large scales, for example, where from about 10 to about 30,000 pounds of the fine particle fraction is separated from the mixture of particle sizes in from about 1 to about 24 hours.

The present invention in embodiments provides a kit, for example, for retrofitting an existing classifier wheel or classification apparatus to enable particle separation and classification embodiments of the present invention wherein the kit comprises, for example:

a disk with a circular opening in the center of the disk; and at least one fastener adapted to attach the disk to the fine particle outlet of an existing classifier wheel.

In embodiments the apparatus of the present invention provides a constant or variable cut point geometry which satisfies the relation $$d_T = \sqrt{\frac{18\eta Q R^2}{8\rho\pi^3 R_1^4 n^2 H}}$$

wherein $d_T$ is the cut point, $\eta$ is the dynamic viscosity, Q is the volumetric air flow rate, $\rho$ is the density of particle material, n is the wheel speed in revolutions per unit time, H is the wheel height at a radial distance R, and the index i denotes the inner edge of the wheel vane.

In embodiments, by varying or modifying, for example, reducing the diameter of the classifier or grinder wheel fines outlet opening or aperture with a removable high spin vortex ring permits greater control over the coarse end or coarse fraction of the particulate size distribution of the particulate material. The variation or modification of the wheel outlet opening or aperture can be accomplished, for example, by mounting or affixing the high spin vortex ring article to the outlet opening or exit port of an existing fluid bed jet mill classifier wheel, for example, an AFG Model available from Alpine. The vortex ring article can be readily interchanged with other vortex rings of different outlet opening diameters, if desired, to better regulate or control the separation of upper or coarse fraction particles in the particle size distribution and therefore better control the quantity and quality of the fine particle fraction. This control of the particle size separation and distribution can, in embodiments, eliminate the need for any coarse particle removal or separation at the classification stage in the manufacture of narrow size distribution toners and thereby affords a substantial time and cost savings in the manufacture of fine toner and related particulate materials.

The high spin vortex ring concept of the present invention can also provide a smaller cut-size at the grinder or classifier compared to similar wheel speeds which advantage can afford increased wheel speed latitude for smaller sized particle separations. The ability to increase wheel speeds, by for example, using maximum grinding air, is important in achieving high or maximum particle throughput rates, especially, for example, in the manufacture of ultrafine toner particles, such as from about 1 to about 5 microns in diameter with very narrow size distributions.

The particle size and quality of the particle separation that can be accomplished in the present invention can be measured and quantified using, for example, the Coulter sizing technique, such as, the aforementioned $D_{25}/D_{75}$ metric or the $D_{84}/D_{50}$ metric.

It will be readily evident to one of ordinary skill in the art that the relative orientation in space of the upper and lower surfaces of the assembled classifier wheel is not critical and can function satisfactorily when oriented in any direction. In operation the particle feed can be provided to the apparatus in various known ways, for example, as a fluid containing suspended particles, or a fluidized particle stream. A preferred fluid is a gas, for example, dry air at or near atmospheric temperature and pressure. The solid particulate can be any material which is readily separable by the classifier wheel and is preferably friable, a non- or only weakly agglomerating, for example, a toner formulation comprising particles of a mixture of a pigment and a resin. The classifier wheel of the present invention can be satisfactorily operated at rotational velocities which are used in conventional classification separators, for example, from about 500 to about 25,000 revolutions per minute, and preferably from about 500 to about 5,000 revolutions per minute, with the result that the separation of fine particles from coarse particles is improved substantially over wheel geometries of the prior art.

Descriptions of exemplary separations obtained with the present invention follow. Particles smaller than about 12 microns are separated from a population of particles ranging in size average diameters of from about 0.1 to about 1,000 microns, as practiced in, for example, a fluid bed grinder, where the larger particles are continuously ground until sufficiently small to be removed through the classifier wheel. Particles smaller than about 4 microns are separated from a population of particles ranging in size average diameter of from about 1 to about 12 microns, as practiced, for example, in a classifier, where undersized particles are removed.

In embodiments of the present invention, there is provided an apparatus and particle separation processes thereof with a separation sharpness index exceeding a value of about 0.7, for example, from about 0.7 to about 1.0.

The cut point of the apparatus and of a classification process corresponds to the nominal particle size at which two opposing and competing forces have substantially equal magnitudes. The magnitude of the two forces acting on an individual particle in a classifier, for example, air drag and centrifugal force, can be calculated using common fluid dynamics equations. These forces, and more importantly, their relative magnitudes, change with position within a classifier wheel. A plot of the cut point (dT) versus radial position (R) can be drawn. Such a graphical analysis has been accomplished by R. Nied and Sickel and reported in an article "Modem Air Classifiers", in *Powder Handling and Processing*, Vol. 4, No. 2, June 1992, the disclosure of which is incorporated herein in its entirety.

Toner compositions can be prepared by a number of known methods, such as admixing and heating resin particles obtained with the processes of the present invention such as water soluble styrene butadiene copolymer derivatives, pigment particles such as magnetite, carbon black, or mixtures thereof, and cyan, yellow, magenta, green, brown, red, or mixtures thereof, and preferably from 0 to about 5 percent of charge enhancing additives in a toner extrusion device, such as the ZSK53 available from Werner Pfleiderer, and removing the formed toner composition from the device. Subsequent to cooling, the toner composition is subjected to grinding utilizing, for example, a Sturtevant micronizer for the purpose of achieving toner particles with a volume median diameter of less than about 25 microns, and preferably of from about 4 to about 12 microns, which diameters are determined by a Coulter Counter. Subsequently, the toner compositions can be classified utilizing, for example, a Donaldson Model B classifier for the purpose of removing toner fines, that is toner particles less than about 4 microns volume median diameter. Alternatively, the toner compositions are ground with a fluid bed grinder equipped with a classifier wheel constructed in accordance with the present invention, and then classified using a classifier equipped with a classifier wheel constructed in accordance with the present invention.

Illustrative examples of resins suitable for toner and developer compositions of the present invention include branched styrene acrylates, styrene methacrylates, styrene butadienes, vinyl resins, including branched homopolymers and copolymers of two or more vinyl monomers; vinyl monomers include styrene, p-chlorostyrene, butadiene, isoprene, and myrcene; vinyl esters like esters of monocarboxylic acids including methyl acrylate, ethyl acrylate, n-butyl acrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; and the like. Preferred toner resins include styrene butadiene copolymers, mixtures thereof, and the like. Other preferred toner resins include styrene/n-butyl acrylate copolymers, PLIOLITESE®; suspension polymerized styrene butadienes, reference U.S. Pat. No. 4,558,108, the disclosure of which is totally incorporated herein by reference.

In toner compositions, the resin particles are present in a sufficient but effective amount, for example from about 70 to about 90 weight percent. Thus, when 1 percent by weight of the charge enhancing additive is present, and 10 percent by weight of pigment or colorant, such as carbon black, is contained therein, about 89 percent by weight of resin is selected. Also, the charge enhancing additive may be coated on the pigment particle. When used as a coating, the charge enhancing additive is present in an amount of from about 0.1 weight percent to about 5 weight percent, and preferably from about 0.3 weight percent to about 1 weight percent.

Numerous well known suitable pigments or dyes can be selected as the colorant for the toner particles including, for example, carbon black like REGAL 330®, nigrosine dye, aniline blue, magnetite, or mixtures thereof. The pigment, which is preferably carbon black, should be present in a sufficient amount to render the toner composition highly colored. Generally, the pigment particles are present in amounts of from about 1 percent by weight to about 20 percent by weight, and preferably from about 2 to about 10 weight percent based on the total weight of the toner composition; however, lesser or greater amounts of pigment particles can be selected.

When the pigment particles are comprised of magnetites, thereby enabling single component toners in some instances, which magnetites are a mixture of iron oxides ($FeO.Fe_2O_3$) including those commercially available as MAPICO BLACK®, they are present in the toner composition in an amount of from about 10 percent by weight to about 70 percent by weight, and preferably in an amount of from about 10 percent by weight to about 50 percent by weight. Mixtures of carbon black and magnetite with from about 1 to about 15 weight percent of carbon black, and preferably from about 2 to about 6 weight percent of carbon black, and magnetite, such as MAPICO BLACK®, in an amount of, for example, from about 5 to about 60, and preferably from about 10 to about 50 weight percent can be selected.

There can also be blended with the toner compositions of the present invention external additive particles including flow aid additives, which additives are usually present on the surface thereof. Examples of these additives include colloidal silicas, such as AEROSIL®, metal salts and metal salts of fatty acids inclusive of zinc stearate, aluminum oxides, cerium oxides, and mixtures thereof, which additives are generally present in an amount of from about 0.1 percent by weight to about 10 percent by weight, and preferably in an amount of from about 0.1 percent by weight to about 5 percent by weight. Several of the aforementioned additives are illustrated in U.S. Pat. Nos. 3,590,000 and 3,800,588, the disclosures of which are totally incorporated herein by reference.

With further respect to the present invention, colloidal silicas, such as AEROSIL®, can be surface treated with the charge additives in an amount of from about 1 to about 30 weight percent and preferably 10 weight percent followed by the addition thereof to the toner in an amount of from 0.1 to 10 and preferably 0.1 to 1 weight percent.

Also, there can be included in the toner compositions low molecular weight waxes, such as polypropylenes and polyethylenes commercially available from Allied Chemical and Petrolite Corporation, EPOLENE N-15® commercially available from Eastman Chemical Products, Inc., VISCOL 550-P®, a low weight average molecular weight polypropylene available from Sanyo Kasei K.K., and similar materials. The commercially available polyethylenes selected have a molecular weight of from about 1,000 to about 1,500, while the commercially available polypropylenes utilized for the toner compositions are believed to have a molecular weight of from about 4,000 to about 5,000. Many of the polyethylene and polypropylene compositions useful in the present invention are illustrated in British Patent No. 1,442,835, the disclosure of which is totally incorporated herein by reference.

The low molecular weight wax materials are optionally present in the toner composition or the polymer resin beads of the present invention in various amounts, however, generally these waxes are present in the toner composition in an amount of from about 1 percent by weight to about 15 percent by weight, and preferably in an amount of from about 2 percent by weight to about 10 percent by weight and may in embodiments function as fuser roll release agents.

Encompassed within the scope of the present invention are colored toner and developer compositions comprised of toner resin particles, carrier particles, the charge enhancing additives illustrated herein, and as pigments or colorants red, blue, green, brown, magenta, cyan and/or yellow particles, as well as mixtures thereof. More specifically, with regard to the generation of color images utilizing a developer composition with charge enhancing additives, illustrative examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra-4-(octadecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, and Permanent Yellow FGL. The aforementioned pigments are incorporated into the toner composition in various suitable effective amounts providing the objectives of the present invention are achieved. In one embodiment, these colored pigment particles are present in the toner composition in an amount of from about 2 percent by weight to about 15 percent by weight calculated on the weight of the toner resin particles.

For the formulation of developer compositions, there are mixed with the toner particles carrier components, particularly those that are capable of triboelectrically assuming an opposite polarity to that of the toner composition. Accordingly, the carrier particles are selected to be of a negative polarity enabling the toner particles, which are positively charged, to adhere to and surround the carrier particles. Illustrative examples of carrier particles include iron powder, steel, nickel, iron, ferrites, including copper zinc ferrites, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing terpolymers of styrene, methylmethacrylate, and a silane, such as triethoxy silane, reference U.S. Pat. Nos. 3,526,533, 4,937,166, and 4,935,326, the disclosures of which are totally incorporated herein by reference, including for example KYNAR® and polymethylmethacrylate mixtures (40/60). Coating weights can vary as indicated herein; generally, however, from about 0.3 to about 2, and preferably from about 0.5 to about 1.5 weight percent coating weight is selected.

Furthermore, the diameter of the carrier particles, preferably spherical in shape, is generally from about 50 microns to about 1,000 microns, and in embodiments about 175 microns thereby permitting them to possess sufficient density and inertia to avoid adherence to the electrostatic images during the development process. The carrier component can be mixed with the toner composition in various suitable combinations, however, best results are obtained when about 1 to 5 parts per toner to about 10 parts to about 200 parts by weight of carrier are selected.

The toner composition of the present invention can be prepared by a number of known methods as indicated herein including extrusion melt blending the toner resin particles, pigment particles or colorants, and a charge enhancing additive, followed by mechanical attrition. Other methods include those well known in the art such as spray drying, melt dispersion, emulsion aggregation, and extrusion processing. Also, as indicated herein the toner composition without the charge enhancing additive in the bulk toner can be prepared, followed by the addition of charge additive surface treated colloidal silicas.

The toner and developer compositions may be selected for use in electrostatographic imaging apparatuses containing therein conventional photoreceptors providing that they are capable of being charged positively or negatively. Thus, the toner and developer compositions can be used with layered photoreceptors that are capable of being charged negatively, such as those described in U.S. Pat. No. 4,265,990, the disclosure of which is totally incorporated herein by reference. Illustrative examples of inorganic photoreceptors that may be selected for imaging and printing processes include selenium; selenium alloys, such as selenium arsenic, selenium tellurium and the like; halogen doped selenium substances; and halogen doped selenium alloys.

The toner compositions are usually jetted and classified subsequent to preparation to enable toner particles with a preferred average diameter of from about 5 to about 25 microns, more preferably from about 8 to about 12 microns, and most preferably from about 5 to about 8 microns. Also, the toner compositions preferably possess a triboelectric charge of from about 0.1 to about 2 femtocoulombs per micron as determined by the known charge spectrograph. Admix time for toners are preferably from about 5 seconds to 1 minute, and more specifically from about 5 to about 15 seconds as determined by the known charge spectrograph. These toner compositions with rapid admix characteristics enable, for example, the development of images in electrophotographic imaging apparatuses, which images have substantially no background deposits thereon, even at high toner dispensing rates in some instances, for instance exceeding 20 grams per minute; and further, such toner compositions can be selected for high speed electrophotographic apparatuses, that is those exceeding 70 copies per minute.

Also, the toner compositions prepared, in embodiments, of the present invention possess desirable narrow charge distributions, optimal charging triboelectric values, preferably of from 10 to about 40, and more preferably from about 10 to about 35 microcoulombs per gram as determined by the known Faraday Cage methods with from about 0.1 to about 5 weight percent in one embodiment of the charge enhancing additive; and rapid admix charging times as determined in the charge spectrograph of less than 15 seconds, and more preferably in some embodiments from about 1 to about 14 seconds.

The classifying apparatus of the present invention, in embodiments, can be constructed using known materials and fabrication techniques and as illustrated herein. In embodiments, a conventional classifier or fluid bed grinder may be readily adapted or retrofitted with constant cut point classifier wheel geometries of the present invention to achieve the aforementioned benefits and advantages, and as illustrated herein. In embodiments, the classifier wheels of the present invention can be constructed or coated with wear resistant material, for example, ceramic, ceramer, composite, and the like, abrasion resistant surface coatings.

The invention will further be illustrated in the following non limiting Example, it being understood that this Example is intended to be illustrative only and that the invention is not intended to be limited to the materials, conditions, process parameters, and the like, recited herein. Parts and percentages are by weight unless otherwise indicated.

EXAMPLE I

The present invention can be used, for example, in the manufacture of Xerox Model DC 250 and DC 265 black toners. The invention can enable a narrower coarse tail of the toner particle size distribution resulting in unexpected and superior xerographic print quality advantages. Data illustrating improved particle size distribution and which data can be obtained with a grinder wheel equipped with high spin vortex ring (HSVR) of the present invention follows.

| Response | Grinder wheel with HSVR | Grinder wheel without HSVR |
|---|---|---|
| $D_{50}$ (vol. median) | 8.8 +/− 0.1 | 8.9 +/− 0.2 |
| UGSD ($D_{84}/D_{50}$) | 1.28 +/− 0.01 | 1.32 +/− 0.02 |

EXAMPLE II

Magnetic Toner Preparation and Evaluation

A polymer resin (74 weight percent of the total mixture) obtained by free radical polymerization of mixtures of styrene and butadiene may be melt extruded with 10 weight percent of REGAL 330® carbon black and 16 weight percent of MAPICO BLACK® magnetite at 120° C., and the extrudate pulverized in a WARING blender and jetted and classified to 8 micron number average sized particles as measured by a Coulter counter with a classifier equipped with a classifier wheel as illustrated herein, reference for example, FIG. 1. A positively charging magnetic toner may be prepared by surface treating the jetted toner (2 grams) with 0.12 gram of a 1:1 weight ratio of AEROSIL R972® (DEGUSSA) and TP-302 a naphthalene sulfonate and quaternary ammonium salt (Nachem/Hodogaya SI) charge control agent.

Developer compositions may then be prepared by admixing 3.34 parts by weight of the aforementioned toner composition with 96.66 parts by weight of a carrier comprised of a steel core with a polymer mixture thereover containing 70 percent by weight of KYNAR®, a polyvinylidene fluoride, and 30 percent by weight of polymethyl methacrylate; the coating weight being about 0.9 percent. Cascade development may be used to develop a Xerox Model D photoreceptor using a "negative" target. The light exposure may be set between 5 and 10 seconds and a negative bias used to dark transfer the positive toned images from the photoreceptor to paper.

Fusing evaluations may be carried out with a Xerox Corporation 5028® soft silicone roll fuser, operated at 7.62 cm (3 inches) per second. The actual fuser roll temperatures may be determined using an Omega pyrometer and was checked with wax paper indicators. The degree to which a developed toner image adhered to paper after fusing is evaluated using a Scotch® tape test. The fix level is expected to be excellent and comparable to that fix obtained with toner compositions prepared from other methods for preparing toners. Typically greater than 95 percent of the toner image remains fixed to the copy sheet after removing a tape strip as determined by a densitometer. Alternatively, the fixed level may be quantitated using the known crease test, reference U.S. Pat. No. 5,312,704, the disclosure of which is totally incorporated herein by reference.

Images may be developed in a xerographic imaging test fixture with a negatively charged layered imaging member comprised of a supporting substrate of aluminum, a photogenerating layer of trigonal selenium, and a charge transport layer of the aryl amine N,N'-diphenyl-N,N'-bis(3-methylphenyl)1,1'-biphenyl-4,4'-diamine, 45 weight percent, dispersed in 55 weight percent of the polycarbonate MAKROLON®, reference U.S. Pat. No. 4,265,990, the disclosure of which is totally incorporated herein by reference; images for toner compositions prepared from the copolymers derived from for example, Example XI are expected to be of excellent quality with no background deposits and of high resolution over an extended number of imaging cycles exceeding, it is believed, about 75,000 imaging cycles.

EXAMPLE III

The present invention can be employed, for example, in the manufacture of particulate materials, such as electrophotographic color toner particles. Typical specific color toner resins include styrene acrylates, styrene methacrylates, polyesters, PLIOLITES®, PLIOTONES® available from Goodyear Chemical Company, styrene-butadiene polymers, particularly styrene-butadiene copolymers wherein the styrene portion is present in an amount of from about 83 to about 93 percent by weight, and preferably about 88 percent by weight, and wherein the butadiene portion is present in an amount of from about 7 to about 17 percent by weight, and preferably about 12 percent by weight, such as resins commercially available as PLIOLITE® or PLIOTONE® from Goodyear. Polyester resins include FE-208 supplied by Dianippon, FAC115 supplied by Kao Corp. along with Indene/propenyltoluene copolymer at levels of 0.2% to 11% by weight supplied by Mitsui Chemical.

A color toner composition can consist of, for example, the above resin combinations and coloring agent for full color development. The coloring agent can include for example, C.I. pigment Yellow 17, C.I. pigment Yellow 180, C.I. pigment Red 57:1, C.I. pigment Red 122, C.I. pigment Blue 15:3, and the like colorants. The amount of coloring agent is preferably from about 0.1 to about 12 percent or parts by weight, based on 100 percent or parts by weight of the resin.

| Base toner formulation | COLOR Toner | | | | | | | |
|---|---|---|---|---|---|---|---|---|
| (weight percent) | K | M | C | Y | K | C | Y | M |
| Polyester resin | 90–95 | 80–90 | 80–90 | | | | | |
| Carbon Black | 3–6 | | | | | | | |
| Indene/propenyltoluene copolymer | 0.2–3 | 4–7 | 4–7 | 2–5 | | | | |
| C.I. Pigment Red 122 | | 3–5 | | | | | | |

-continued

| Base toner formulation | COLOR Toner | | | | | | | |
|---|---|---|---|---|---|---|---|---|
| (weight percent) | K | M | C | Y | K | C | Y | M |
| C.I. Pigment Red 57:1 | | 2–4 | | | | | | 3–5 |
| C.I. Blue Pigment: 15:3 | | | 3–5 | | | 3–5 | | |
| C.I. Pigment Yellow 180 | | | | 5–12 | | | 4–7 | |
| FE 208 Resin | | | | | 90–100 | 85–95 | 85–95 | 85–95 |
| Carbon Black 25B | | | | | 1–5 | | | |

where:
K = Black toner;
M = Magenta toner;
C = Cyan toner; and
Y = Yellow toner.

Other toner compositions may be readily prepared by conventional means from the pigmented thermoplastic resins particles and the improved classification apparatus and processes thereof of the present invention, including colored toners, single component toners, multi-component toners, toners containing special performance additives, and the like.

The present invention can also be used for powder processing of fine grains, flour, and ceramic powders. In embodiments, the apparatus and processes of the present invention can be selected for and employed in the separation classification of friable and non-friable particulate materials including, but not limited to, crystalline, semi-crystalline, and amorphous materials, for example, organics and inorganics, composites thereof, and mixtures thereof. Organics include, for example, resins, polymers, elastomers, dyes, pigments, pharmaceuticals, latex particles, and the like. Inorganics include, for example, metals, metal oxides, minerals, and the like, and mixtures thereof, such magnetites and silicas. Composites include, for example, compounded or physical mixtures of organic compounds and inorganic compounds.

Other modifications of the present invention may occur to one of ordinary skill in the art based upon a review of the present application and these modifications, including equivalents thereof, are intended to be included within the scope of the present invention.

What is claimed is:

1. A classifier wheel comprising:

an upper solid surface and a lower surface defining a first concentric circular opening therein;

a plurality of blade vanes connecting the upper surface to the lower surface and defining a peripheral edge of the upper and lower surfaces, and an article comprising:

a disk defining a concentric circular opening; and a fastener for concentrically attaching the disk to a particle outlet opening of said classifier wheel and wherein said article is fixed to the lower surface defining a second concentric circular opening within the first concentric circular opening and reduces a diameter of the first concentric circular opening.

2. A classifier wheel in accordance with claim 1, wherein the wheel has an internal height(H) of from about 10.0 centimeters to about 20.0 centimeters.

3. A classifier wheel in accordance with claim 1, wherein the wheel has a lower surface diameter(D) of from about 20.0 centimeters to about 30.5 centimeters.

4. A classifier wheel in accordance with claim 1, wherein the second circular opening has a diameter(d) of from about 5.0 centimeters to about 13.5 centimeters.

5. A classifier wheel in accordance with claim 1, wherein the upper surface and the lower surface are substantially parallel.

6. A classifier wheel in accordance with claim 1, wherein the upper surface and the lower surface are inwardly curvilinear from about a peripheral edge of the wheel to about the center of the wheel.

7. An apparatus for the classification of solid particulates entrained in a fluid, comprising:

a housing containing a feed inlet, a fine fraction outlet, and a coarse fraction outlet; and a classifier wheel comprising an upper solid surface and a lower surface defining a first concentric circular opening therein;

a plurality of blade vanes connecting the upper surface to the lower surface at the peripheral edges of the upper and lower surfaces, and an article comprising:

a disk defining a concentric circular opening; and a fastener for concentrically attaching the disk to a particle outlet opening of said classifier wheel and wherein said article is fixed to the lower surface which forms a second concentric circular opening within the first concentric circular opening and reduces a diameter of the first concentric circular opening.

8. An apparatus in accordance with claim 7, wherein the fluid is compressed air.

9. An apparatus in accordance with claim 7, wherein the solid particulates are a toner formulation comprising a pigment and a resin.

10. A process for separating and classifying particulates in an apparatus in accordance with claim 7, comprising:

rotating the classifier wheel at speed of from about 500 to about 5,000 revolutions per minute; and introducing to the apparatus a solid particle feed comprising a fluid stream containing particulates of from about 0.1 to about 10,000 microns in diameter, wherein the fine particles in the particle feed move toward the center of the wheel and therafter exit the classifier wheel and housing via the fine fraction outlet opening, and the coarse particles move toward the periphery of the wheel and exit the wheel via the coarse fraction outlet.

11. A process in accordance with claim 10, wherein the particulates in the fluid stream are continuously classified within the apparatus to permit a separated fine particle fraction with a weight average particle diameter of from about 1 to about 10 micrometers and a standard deviation of from about 0.1 to about 0.5 micrometers.

12. A process in accordance with claim 11, wherein from about 10 to about 10,000 pounds of the fine particle fraction is separated in from about 1 to about 24 hours.

13. An apparatus comprising:

a classifier wheel comprising an upper solid surface and a lower surface defining a first concentric circular opening therein and a plurality of blade vanes connecting the upper surface to the lower surface;

a disk defining a concentric circular opening; and at least one fastener adapted to attach the disk to a particle outlet opening of the classifier wheel wherein said disk is fixed to the lower surface of the classifier wheel to define a second concentric circular opening within the first concentric circular opening and reduces a diameter of the first concentric circular opening.

14. An apparatus in accordance with claim 13, wherein the disk exhibits a thickness adjacent a periphery of the disk and a thickness adjacent the particle outlet, further wherein the thickness of the disk adjacent the particle outlet is greater than the thickness of the disk adjacent the periphery of the disk.

15. An apparatus in accordance with claim 13, further comprising a lip or rim adjacent to the concentric circular opening of the disk said lip having a thickness of from about 1.5 to about 5 times a relative thickness of the disk.

16. An apparatus in accordance with claim 13, wherein a diameter of the circular opening of the disk is fixed.

17. An apparatus in accordance with claim 13, wherein a diameter of the circular opening of the disk is adjustable.

18. An apparatus in accordance with claim 13, wherein a diameter of the circular opening of the disk is from about 1 centimeter to about 10,000 centimeters.

19. An apparatus in accordance with claim 13, wherein a diameter of the disk is from about 10 centimeters to about 1,000 centimeters.

20. An apparatus in accordance with claim 13, wherein the fastener is one or more bolts or screws.

21. An apparatus in accordance with claim 13, wherein the fastener is one or more clamps.

22. An apparatus in accordance with claim 13, further comprising a centrifugal value for adjusting the diameter of the circular opening of the disk.

* * * * *